US007237979B2

(12) United States Patent
Behan et al.

(10) Patent No.: US 7,237,979 B2
(45) Date of Patent: Jul. 3, 2007

(54) SECURITY BARRIER

(75) Inventors: Kevin Behan, Watford (GB); Paul Behan, Watford (GB)

(73) Assignee: Catsclaw International Limited, Watford (GB)

( * ) Notice: Subject to any disclaimer, the term of this patent is extended or adjusted under 35 U.S.C. 154(b) by 0 days.

(21) Appl. No.: 10/874,787

(22) Filed: Jun. 23, 2004

(65) Prior Publication Data

US 2005/0031409 A1 Feb. 10, 2005

(30) Foreign Application Priority Data

Jun. 27, 2003 (GB) ..... 0314972.1

(51) Int. Cl.
*E01F 13/00* (2006.01)

(52) U.S. Cl. ..... 404/6; 49/49

(58) Field of Classification Search ..... 404/6.9–11; 49/49; 116/63 R, 63 P
See application file for complete search history.

(56) References Cited

U.S. PATENT DOCUMENTS

| | | | | | |
|---|---|---|---|---|---|
| 1,377,488 | A * | 5/1921 | Johnson | 116/54 |
| 1,604,014 | A * | 10/1926 | Billups | 49/334 |
| 1,613,019 | A * | 1/1927 | Caudle | 116/46 |
| 3,263,578 | A * | 8/1966 | Pilcher | 404/13 |
| 4,016,679 | A * | 4/1977 | Ellefson | 49/49 |
| 4,697,541 | A * | 10/1987 | Wicker | 116/28 R |
| 4,818,137 | A * | 4/1989 | Gorlov | 404/6 |
| 4,881,845 | A * | 11/1989 | McKay | 404/6 |
| 4,955,753 | A * | 9/1990 | McKay | 404/6 |
| 5,026,203 | A | 6/1991 | Gorlov | |
| 5,038,136 | A * | 8/1991 | Watson | 340/480 |
| 6,119,399 | A * | 9/2000 | McCain et al. | 49/340 |
| 6,234,105 | B1 * | 5/2001 | Lamparter | 116/28 R |
| 6,402,421 | B1 * | 6/2002 | Ottavi et al. | 404/6 |
| 6,460,292 | B1 * | 10/2002 | Rodriguez et al. | 49/49 |
| 6,996,935 | B1 * | 2/2006 | Decker et al. | 49/340 |
| 2002/0139904 | A1 * | 10/2002 | Lowell | 248/145 |
| 2005/0150612 | A1 * | 7/2005 | Cook | 160/218 |

FOREIGN PATENT DOCUMENTS

| | | | |
|---|---|---|---|
| BE | 1 002 751 | A6 | 5/1991 |
| DE | 7 406 696 | | 5/1974 |
| DE | 2451743 | A * | 5/1976 |
| EP | 537095 | A2 * | 4/1993 |

OTHER PUBLICATIONS

English Summary of BE 1 002 751 A6, published May 28, 1991, listed above.
English Summary of DE 7 406 696, published May 30, 1974, listed above.
European Search Report dated Oct. 25, 2004 for 04253732.4, in the name of Kevin Behan, et al.

* cited by examiner

*Primary Examiner*—Gary S. Hartmann
(74) *Attorney, Agent, or Firm*—Christie, Parker & Hale, LLP

(57) ABSTRACT

A barrier for stopping the progress of vehicles, comprising a pivoted barrier adapted to pivot about a non-vertical axis from a first position generally alongside a carriageway to a position where it at least partially blocks the carriageway, and adapted to move between the positions under the influence of gravity.

19 Claims, 3 Drawing Sheets

SECURITY BARRIER

CROSS-REFERENCE TO RELATED APPLICATION

This application claims priority of British Patent Application Number 0314972.1, filed on Jun. 27, 2003.

This invention relates to a security barrier. In particular, but not exclusively, it relates to a barrier for stopping the passage of a vehicle.

The need to stop vehicles whose drivers or controllers have a possibly aggressive or threatening intent is ever increasing, not least because of the risk of territories activities.

Public buildings and other high profile or at risk locations are often protected by manned barriers. These usually have a closed position in which they lie substantially perpendicular to the direction of the carriageway, ie direction of travel of the vehicle. Alternatively, permanent barriers, such as concrete blocks may be installed to protect high risk areas in time of high tension.

The moveable barriers used up to now can be placed perpendicularly across a passageway and therefore if driven at directly at high speed, can sometimes be broken through. Furthermore, in a head-on collision, the occupants of the vehicle are likely to be seriously injured or killed, the vehicle destroyed and the barrier and road structure would require re-engineering or replacing. Additionally, the impact may lead to the detonation of any explosives on board the vehicle.

Furthermore, it is often a requirement to be able to close a barrier quickly when a threatening vehicle is seen. Motorised barriers can be complicated and the mechanism for opening and closing the barrier can be expensive or can be required to be placed in the position where it hinders normal passageway through a carriageway.

The present invention arose in an attempt to provide an improved barrier structure which overcomes these problems.

According to the present invention in a first aspect there is provided a barrier for stopping the passage of a vehicle along a carriageway in a predetermined direction, the barrier comprising a barrier beam mounted for pivotable movement about a non-horizontal axis for movement between a first position in which it extends generally along a first side of the carriageway and a second position in which it extends obliquely across the carriageway.

Preferably, the barrier pivots about a non-vertical axis such that its deployment from the first to the second position is at least partly (preferably solely) powered by gravity.

This can then mean that no additional drive mechanism is required, saving energy and space. The system is also non-threatening in appearance.

The barrier may comprise a receiving post having a recess or other means for receiving the beam when in the second deployed position, which recess or other means is at a lower height than the height of the end of the beam distal from the pivot, when in the first position.

The beam may be held in the first position by a further latching apparatus which is releasable either directly or under remote control so as to enable the beam to fall at least partly under gravity to the second deployed position.

Alternative embodiments, a further static barrier may also be deployed generally parallel to the direction of travel so that when the barrier is deployed a vehicle heading in that direction is forced into a tapering part between the moveable and static barriers.

Embodiments of the invention will now be described, by way of example only, with reference to the accompanying drawings in which.

Figure 1:
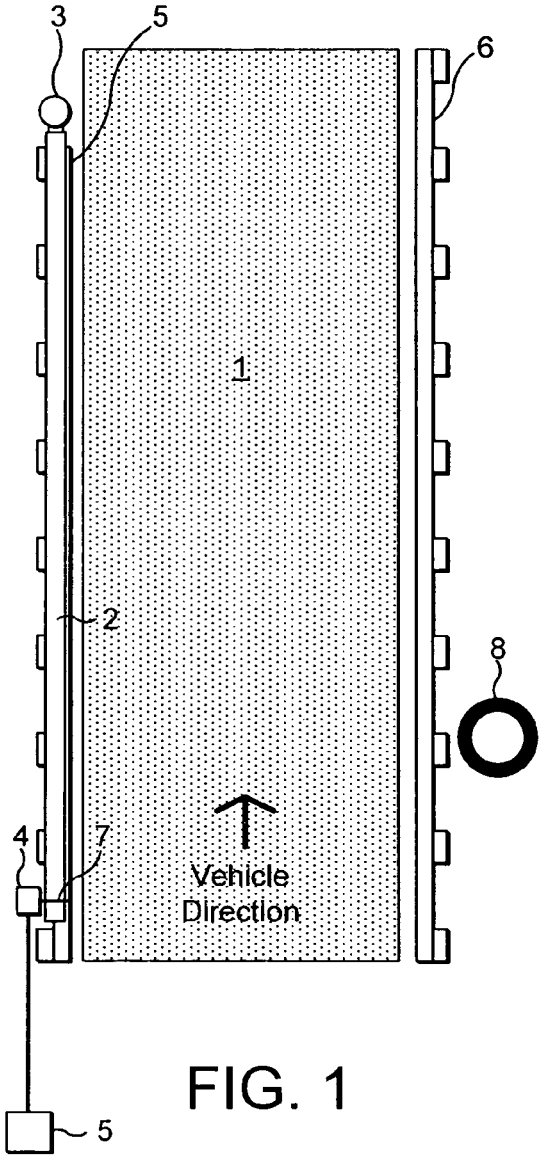
FIG. 1 is a plan view of a barrier in a first position adjacent a carriageway.

Referring to FIG. 1, a barrier apparatus is shown schematically. The barrier can be deployed across a carriageway 1. This may be a public highway or may be a carriageway leading to a building or other area which is to be protected against unauthorised vehicles travelling too close to them which may present a terrorist or other threat. A moveable barrier 2 is in the form of a strong beam able to withstand large forces and is pivotably mounted on a post 3. Rigid, static, barriers 5 and 6 are positioned along the sides of the carriageway to ensure that a vehicle cannot divert away from the barrier and these are sufficiently strong to be able to withstand the impact of a vehicle driven at them either directly or obliquely.

The barrier may be used to deflect the vehicle into a designated area, in which case the static barrier can be omitted, or may be sacrificial, allowing the vehicle to pass through into the designated area. This area may include a water trap, sandpit or be any other area where the vehicle and its contents can be dealt with safely.

In FIG. 1, the moveable barrier 2 is shown as being in a non-deployed position lying generally along one side of the carriageway so that it does not impede progress of vehicles along the carriageway. Vehicle can then be driven unimpeded in the direction shown. The barrier 2 is latched to a first latching post or means 4 including a latching means 7 that releasably secures the post in this nondeployed position but is releasable upon demand. This may be a simple mechanical catch which is lifted or otherwise released by an operator or may be a latching means which is operated by motors or other means and preferably by a remote control 5. In this way, the latch may be connected by a wire or cable (eg optical cable) linked to an operator or security guard positioned remotely or may be operated by a wireless link, such as a radio link, infrared, ultrasound or other links.

A latching post 8 is mounted on the other side of the carriageway and forwardly of the pivot 3.

Figure 2:
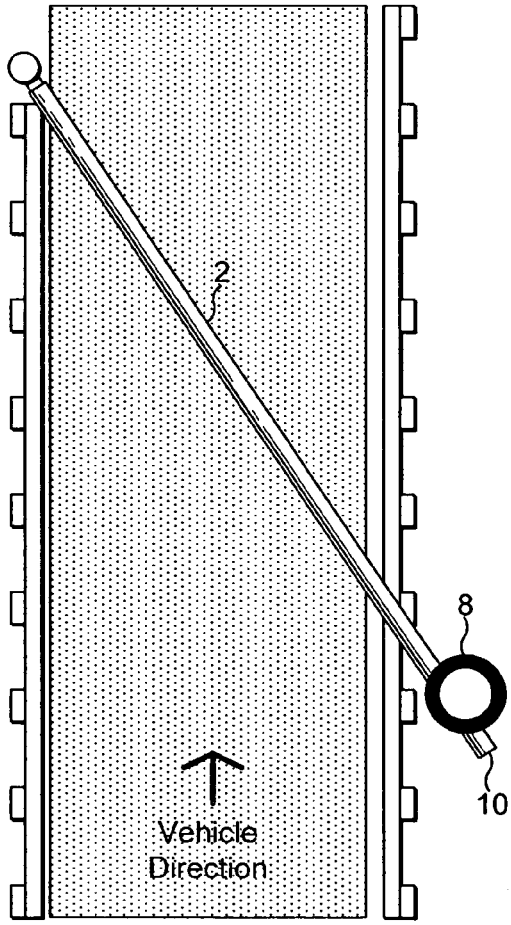
FIG. 2 is a plan view of the barrier in a deployed position.

FIG. 2 shows the position when the main barrier is deployed. The latch 7 is released and the barrier moves to a position where it abuts against latching post 8 to therefore lie obliquely across the carriageway 1.

The movement may be a powered one using any suitable drive mechanism, or, as is more preferred in embodiments of the invention, it may be at least partially gravity fed, in which case the barrier is adapted to pivot not about a non-vertical axis so that its end 10 moves from a higher position where it is latched in the non-deployed position by latch 7 to a lower position where it is held or abuts against post 8.

Post 8 may simply be a solid post, strong enough to withstand firstly the force of the barrier abutting it and secondly to be able to withstand the force of a vehicle impinging against or striking the barrier and therefore causing the barrier to exert a force against the post or latch 8. The latch may alternatively include a recess or other means for receiving the barrier.

Figure 3:
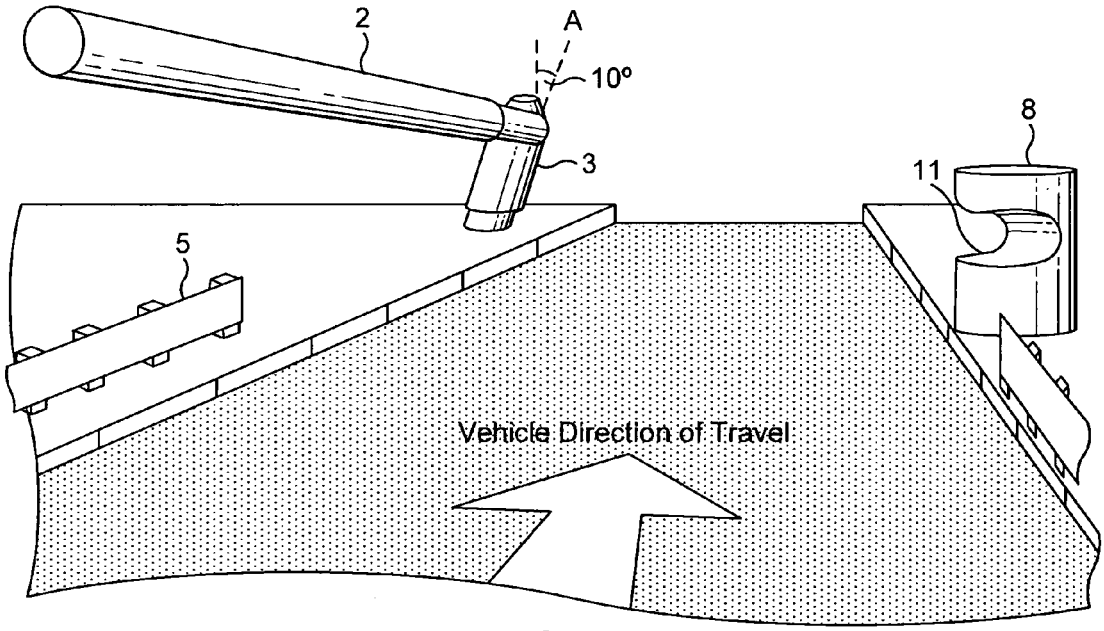
FIG. 3 is a perspective view of the barrier in the first position.
Figure 4:
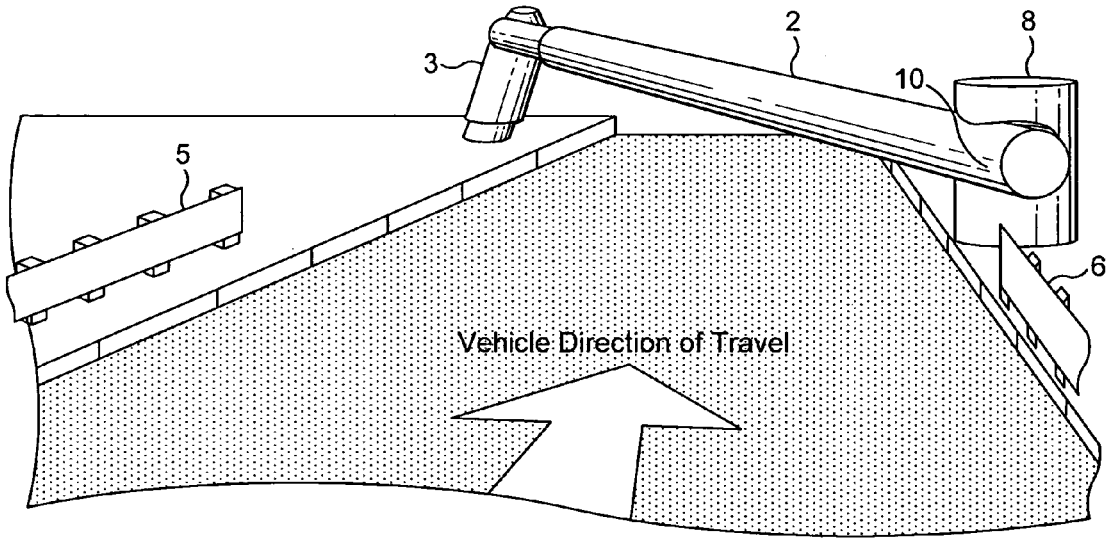
FIG. 4 is a perspective view of the barrier in the deployed position.

FIGS. 3 and 4 show a perspective view illustrating more clearly the way in which the barrier is deployed under gravity.

Figure 5:
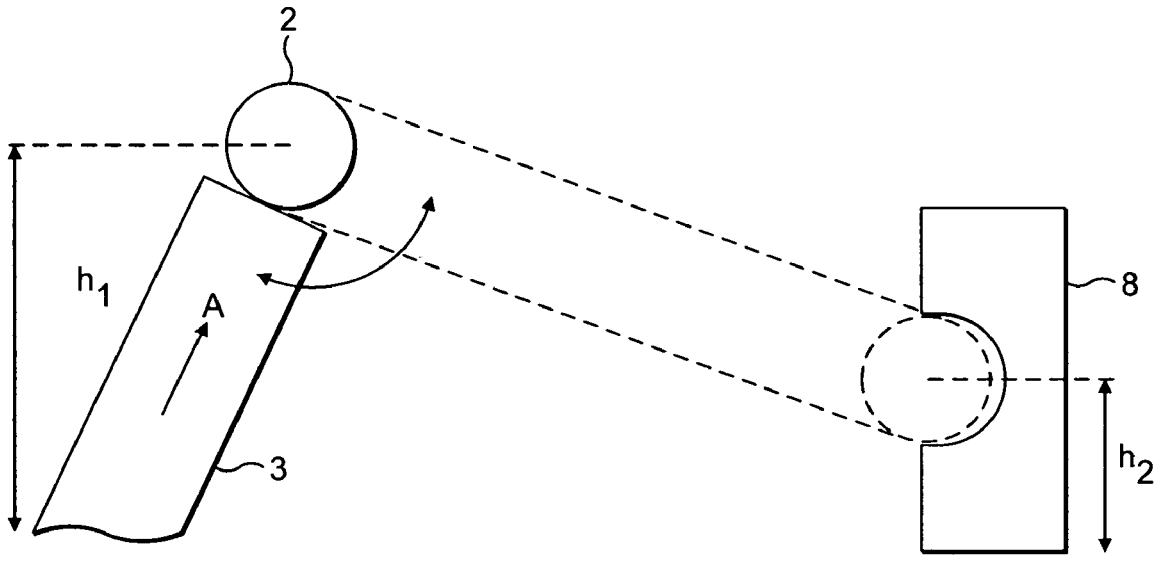
FIG. 5 is a schematic end view showing operation of the barrier.

Referring to FIG. 3, it is seen that the barrier is pivoted about an axis A which is non-vertical. This may be, for example, about 10°, although it may be other angles if appropriate. The pivot post 3 is shown as being set into the ground surface at this angle so that axis A is parallel or is the axis of the post. Alternatively, the post may be set substantially vertically into the ground and have a top portion or a portion about which the beam pivots which is at the desired angle A. However, setting the post into the ground at angle A does enable the forces on this to be transferred to its base for maximum strength and resistance. The beam may be secured to the post 3 by a simple pin or bolt arrangement or may be otherwise secured by any suitable pivoting mechanism. In FIGS. 3 and 4, the undeployed latching mechanism 4, 7, 5 is not shown for clarity. The latching post 8, against which the beam deploys is shown and it will be seen that in this embodiment post 8 includes a recess 11 for receiving the beam. This is more clearly shown in FIG. 5 which illustrates how the beam can fall through gravity. As shown in FIG. 5, the beam is mounted, so that the end of the beam distal from the pivot is set at height h1 above ground but falls, at the latching post 8 to a height h2 which is lower than h1.

The direction of the leaning pivot post is preferably set or fixed so that when beam 2 engages the receiving post 8, the beam is horizontal with the road surface.

Accordingly, when the beam is released it pivots about axis A and falls under gravity towards post 8 and therefore from the position shown in FIG. 3 to that in FIG. 4 where the end 10 of the beam abuts within the recess 11 in post 8. Accordingly, when deployed, a vehicle travelling in the direction of travel shown, will, unless it stops before it strikes the beam 2 obliquely and the force of this will be withstood by the pivot post 3 and latch post 8. Probably, most of the force will be withstood by latch post 8 because post 8 is positioned forwardly of pivot post 3 and therefore the vehicle is likely to strike a part of the beam 2 which is closer to post 8 than to post 3.

The beam may be physically or mechanically moved back (eg by a winch, or by hand), and latched at the non-deployed position after a threat has passed.

In the schematic example of FIGS. 3 and 4, the static barriers 5 and 6 end before the posts 3 and 8. However, in other embodiments, these may continue and, as described, if static barrier 5 is extended closer to post 8 then a converging channel will be formed between beam 2 and barrier 5 which can prevent a vehicle from turning off left-wise (in the example shown) and off the carriage and can trap the vehicle between barriers 2 and 5.

The invention claimed is:

1. A barrier for stopping passage of a vehicle along a carriageway in a predetermined direction, the barrier comprising:

a beam mounted for pivotable movement about a non-horizontal axis for movement between a first position extending generally along a first side of the carriageway and a second position extending obliquely across the carriageway to direct the vehicle away from the beam, wherein deployment from the first position to the second position is at least partly achieved through gravity; and a receiving post for receiving the beam in the second position.

2. A barrier as claimed in claim 1, wherein an end of the beam distal from a pivoting end moves from a first height in the first position to a second lower height in the second position.

3. A barrier as claimed in claim 1, wherein the receiving post includes a recess for receiving the beam.

4. A barrier as claimed in claim 1, wherein at the second position the beam is generally horizontal to the surface of the carriageway.

5. The barrier of claim 1, further comprising a designated area, a target vehicle being deflected into the designated area.

6. The barrier of claim 5, wherein the designated area is a water trap or a sand pit.

7. The barrier of claim 1, further comprising a remote control for remotely causing the beam to deploy.

8. The barrier of claim 7, further comprising a latch operated by the remote control for causing the beam to deploy.

9. The barrier of claim 1, further comprising a static barrier for preventing vehicles from leaving the carriageway prior to being deflected.

10. The barrier of claim 9, wherein the static barrier is sacrificial.

11. The barrier of claim 9, further comprising a designated area, a target vehicle being deflected into the designated area.

12. The barrier of claim 11, wherein the designated area is a water trap or a sand pit.

13. The barrier of claim 1, further comprising a static barrier configured to direct the vehicle into a tapered area between the beam in the second position and the static baffler.

14. A barrier for stopping passage of a vehicle along a carriageway in a predetermined direction, the barrier comprising:

a beam mounted for pivotable movement about a non-horizontal axis for movement between a first position extending generally along a first side of the carriageway and a second position extending obliquely across the carriageway to direct the vehicle away from the beam, wherein deployment from the first position to the second position is at least partly achieved through gravity; and means for releasably holding the beam in the first position adapted to release the beam to allow the beam to deploy to the second position.

15. The baffler of claim 14, wherein an end of the beam distal from a pivoting end moves from a first height in the first position to a second lower height in the second position.

16. A barrier for stopping passage of a vehicle along a carriageway in a predetermined direction, the barrier comprising:

a beam mounted for pivotable movement about a non-horizontal axis for movement between a first position extending generally along a first side of the carriageway and a second position extending obliquely across the carriageway to direct the vehicle away from the beam, wherein the beam pivots about a non-vertical pivoting axis between the first position and the second position, and wherein the beam is mounted on a pivot support, the pivot support being mounted to the ground about an axis parallel to or concentric to the pivoting axis.

17. The baffler of claim 16, wherein an end of the beam distal from a pivoting end moves from a first height in the first position to a second lower height in the second position.

18. A barrier as claimed in claim 16 wherein at the second position the beam is generally horizontal to the surface of the carriageway.

19. A barrier as claimed in claim 16, further comprising a static barrier located to form a convergent path with the beam in the second position, wherein the beam is pivoted at a point on a same side of the carriageway as the static barrier.

* * * * *

UNITED STATES PATENT AND TRADEMARK OFFICE

CERTIFICATE OF CORRECTION

PATENT NO. : 7,237,979 B2
APPLICATION NO. : 10/874787
DATED : July 3, 2007
INVENTOR(S) : Behan et al.

It is certified that error appears in the above-identified patent and that said Letters Patent is hereby corrected as shown below:

In the Claims

| | |
|---|---|
| Column 4, line 33, Claim 13 | Delete "baffler",<br>Insert --barrier-- |
| Column 4, line 48, Claim 15 | Delete "baffler",<br>Insert --barrier-- |
| Column 5, line 1, Claim 17 | Delete "baffler",<br>Insert --barrier-- |
| Column 5, line 4, Claim 18 | After "claim 16",<br>Insert --,-- |

Signed and Sealed this

Eleventh Day of March, 2008

JON W. DUDAS
*Director of the United States Patent and Trademark Office*